US007703704B2

(12) United States Patent
Göhring et al.

(10) Patent No.: US 7,703,704 B2
(45) Date of Patent: Apr. 27, 2010

(54) SPRAY GUN

(75) Inventors: Alfred Göhring, Salem (DE); Hermann Probst, Ravensburg (DE); Elmar Krayer, Langenargen (DE); Jens Ulbrich, Friedrichshafen (DE)

(73) Assignee: J. Wagner GmbH, Markdorf (DE)

( * ) Notice: Subject to any disclaimer, the term of this patent is extended or adjusted under 35 U.S.C. 154(b) by 442 days.

(21) Appl. No.: 11/702,842

(22) Filed: Feb. 6, 2007

(65) Prior Publication Data

US 2007/0221753 A1 Sep. 27, 2007

(30) Foreign Application Priority Data

Feb. 11, 2006 (EP) ..... 06002792

(51) Int. Cl.
*B05B 7/30* (2006.01)

(52) U.S. Cl. ..... 239/354; 239/332; 239/333; 239/375; 239/601; 220/4.26; 220/4.07

(58) Field of Classification Search ..... 239/332, 239/354, 375, 601, 320, 333; 220/4.26, 4.27, 220/4.28, 4.03, 4.07, 506, 554, 551; 222/464.1, 222/325

See application file for complete search history.

(56) References Cited

U.S. PATENT DOCUMENTS 2,228,861 A 1/1941 Wegener
3,401,842 A * 9/1968 Morrison ..... 222/183
4,419,093 A * 12/1983 Deaton ..... 604/540
4,687,140 A * 8/1987 Hasegawa ..... 239/332
4,693,423 A * 9/1987 Roe et al. ..... 239/332
5,141,162 A * 8/1992 Gunderson et al. ..... 239/332
5,575,398 A * 11/1996 Robbins, III ..... 220/8

FOREIGN PATENT DOCUMENTS

DE 668 093 11/1938
DE 32 32 422 3/1984
EP 1 340 550 9/2003

* cited by examiner

*Primary Examiner*—Dinh Q Nguyen
(74) *Attorney, Agent, or Firm*—Pandiscio & Pandiscio

(57) ABSTRACT

In a spray gun for spraying paint and similar media, there is provided a gun housing and a reservoir tank removably attached to the gun housing for holding the medium to be sprayed. The reservoir tank is configured as a commercially available storage container, for example in the form of a paint can, and is directly attached via an adapter to a projection connected to the gun housing. Thus, commercially available storage containers, differing considerably in their dimensions, can be directly fitted onto the gun housing in a short time and by a reliable method. Viscosity settings and transferring of media to be processed from one container to another are therefore not necessary, and the medium can be matched to the particular working implement and application.

5 Claims, 11 Drawing Sheets

Figure 1:
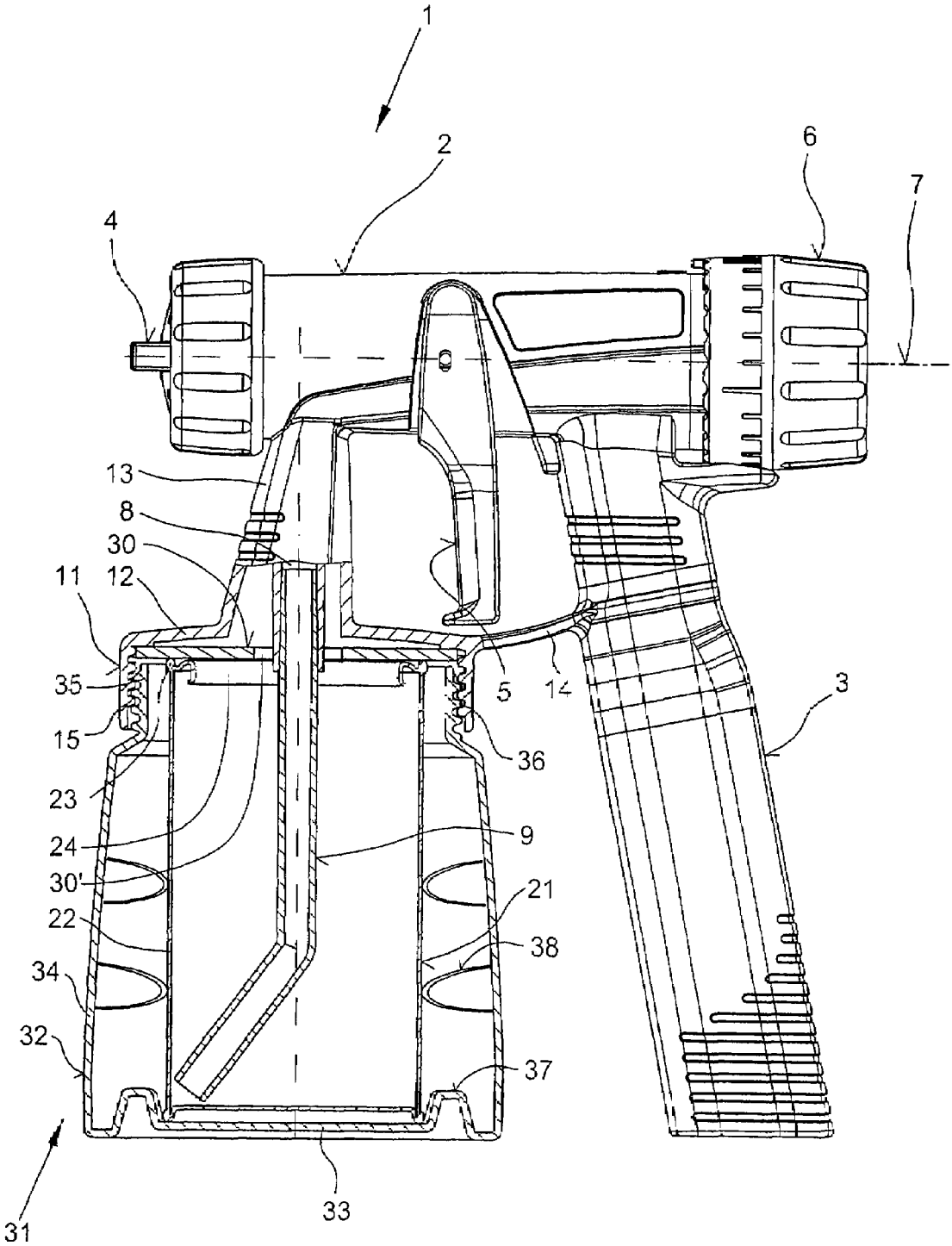

Fig. 11
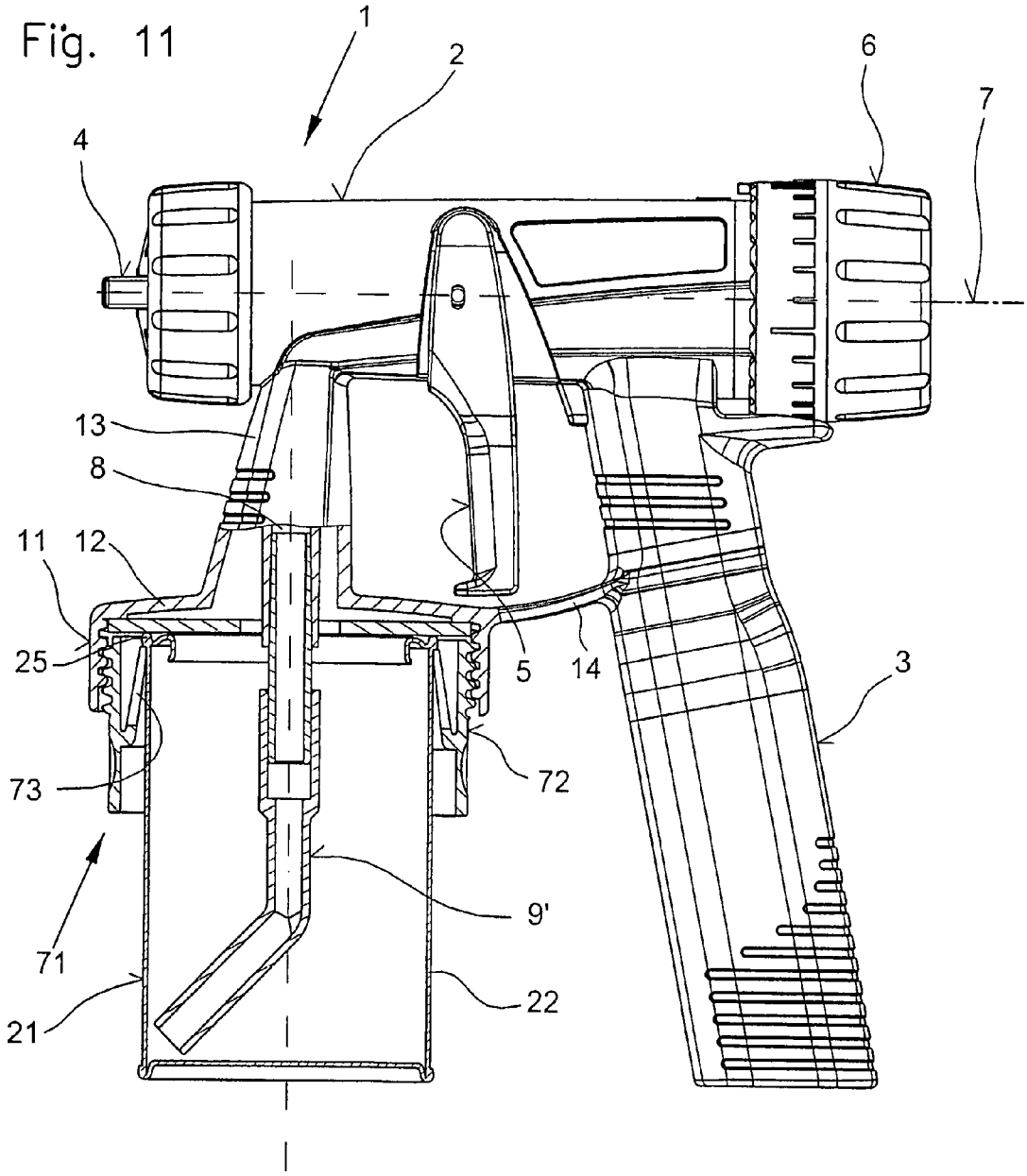
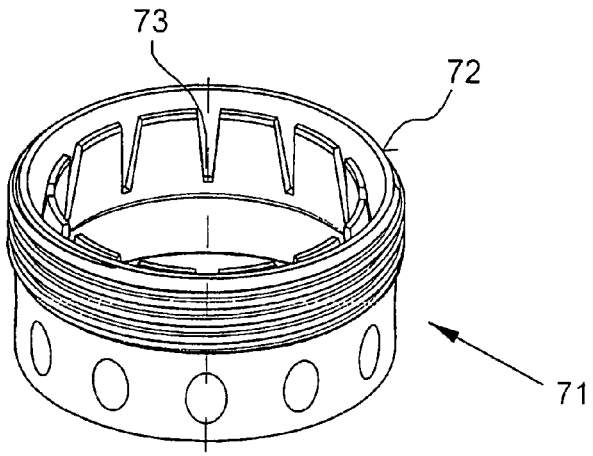
Fig. 12

SPRAY GUN

BACKGROUND OF THE INVENTION

1. Field of the Invention

The present invention relates to a spray gun for spraying paints and similar viscous media that can be propelled pneumatically or electrically, comprising a gun housing for accommodating the propulsion mechanism, the components of the spray gun that effect mixture and/or metering, a handle projecting from the gun housing and a reservoir tank removably attached to the gun housing for holding the medium to be processed, with the possibility of introducing the medium from the reservoir tank into the gun housing of the spray gun via a feed duct that, in a preferred embodiment, is provided with a riser pipe.

2. Description of the Prior Art

Spray guns of this type have been described in numerous different configurations and have also proven their effectiveness in practice. In order to enable a medium to be processed with these spray guns, it is necessary to remove the reservoir tank from the gun housing and to fill it accordingly. This procedure is time-consuming, and also the paint or other medium can easily be spilled. Furthermore, it is often essential to carry out extensive cleaning work when changing the medium to be processed, and this also takes time. However, the principal disadvantage of these spray guns is that the viscosity of the medium put into the reservoir tank has to be adapted to the particular design configurations of the spraying device by means of which the medium is to be sprayed. This requires expert knowledge and skill. Frequently, it is not possible to achieve an optimum working method with spray guns of prior art.

SUMMARY OF THE INVENTION

The purpose of the present invention is therefore to create a spray gun of the aforementioned type that enables reservoir tanks of different configurations to be reliably attached to it straightforwardly and within a short period of time, these tanks being filled with a medium that is adapted to the spray gun to be used and/or the work to be undertaken, meaning that it is possible to process the material immediately after the reservoir tank has been attached to the gun housing. Accordingly, setup times should be practically eliminated and also it should not be necessary to undertake any cleaning work; instead, it should be possible simply to remove one reservoir tank after a working step and to seal it.

In accordance with the present invention, this is achieved in a spray gun of the aforementioned type in that the reservoir tank is configured as a commercially available storage container, in particular in the form of a paint can, and that the storage container is attached directly to a projection by means of a one or multi-part adapter, the projection preferably being configured as a cover or plate that is connected to the gun housing and/or to the handle by a web.

It is advantageous in this case for the adapter to be configured as a hollow body in the form of a pot into which the storage container can be inserted in an oriented position. This can be achieved in that the adapter is provided with projecting support ribs in the area of the base and/or walls. In addition, it should be possible to screw the adapter into the projection by means of a male thread provided, in a preferred embodiment, on a mouthpiece.

Also, the hollow body should be configured as an approximately cylindrical vessel with a U-shaped cross section having enclosed walls, in order to be used as a reservoir tank to be attached to the spray gun if necessary. However, the walls of the hollow body can also have penetrations worked into them in order to allow the storage container to be inserted or removed easily.

According to one configuration variant, there is also provision for the hollow body of the adapter to have a contact shoulder formed by a construction in the area facing the spray gun in order to support the storage container and, in the area of the base, for the hollow body of the adapter to have an adjustment element, for example in the form of a setscrew or a compression spring, that acts on the adapter either directly or via intermediate elements so that spray cans of different heights can be inserted into the hollow body in a straightforward manner.

In order to adjust to the different heights of storage containers, however, the hollow body of the adapter can also have one or several inserts assigned to it that are configured with different heights and, in a preferred embodiment, can be interlocked together, these inserts being inserted in between the base of the hollow body and the base of the storage container and/or between the container and the projection. It is also possible, however, for the hollow body to be provided with a base in an adjustable arrangement that can be moved towards the projection, e.g. by means of a female thread or a ratchet profile.

Furthermore, it is advantageous for the hollow body of the adapter to be adapted to the shape and size of the storage container that is to be inserted into it.

The hollow body can also be surrounded by a jacket that is firmly attached to it, having a support surface running flush with the support surface of the handle in one plane.

In accordance with a different embodiment, the adapter can also be configured as a clamping belt attached directly to the plate-shaped projection or to an adapter that can be screwed onto the projection, in which case the clamping belt should act on the base of the reservoir tank by means of a pressure piece through which the clamping belt is passed and is secured at one end onto the plate or onto the adapter, e.g. on an eyelet, and can be tensioned at the other end by means of a clamping lever.

According to a further embodiment, provision is made for the adapter to be configured as a clamping ring and for this to be screwed onto the projection, and for the storage container to be clamped onto the projection or a seal inserted into the projection by means of clamping arms projecting radially inwards, acting in a preferred embodiment on a radially projecting collar of the storage container.

Furthermore, it is advantageous for the length of the riser pipe to be adapted to the height of the storage container, for example by means of projections or intermediate pieces, and for the cover of the storage container to be supported on the projection by a plate-shaped seal.

If a spray gun is configured in accordance with the present invention, it is possible for commercially available storage containers of widely different dimensions to be attached straightforwardly and in a very short time to the gun housing, resulting in a reliable and direct connection, in which case these containers can contain a medium that is ready for immediate processing. Preparatory measures such as adjusting the viscosity are consequently no longer required, rather the medium to be processed can be optimally adapted to the particular working implement and application during the manufacture of a paint.

Furthermore, it is beneficial that, if the spray gun configured in accordance with the present invention is used, there will be scarcely and need for transferring the medium to be processed from one container to another or any need for cleaning work. This is because the storage container can easily be removed from the gun housing following completion of a working procedure and, if necessary, sealed with the original cap or disposed of. This means there are hardly any setup times. By offering straightforward handling in this manner, the processing of media with different consistencies is facilitated to a considerable extent without requiring additional work.

BRIEF DESCRIPTION OF THE INVENTION

Figure 9:
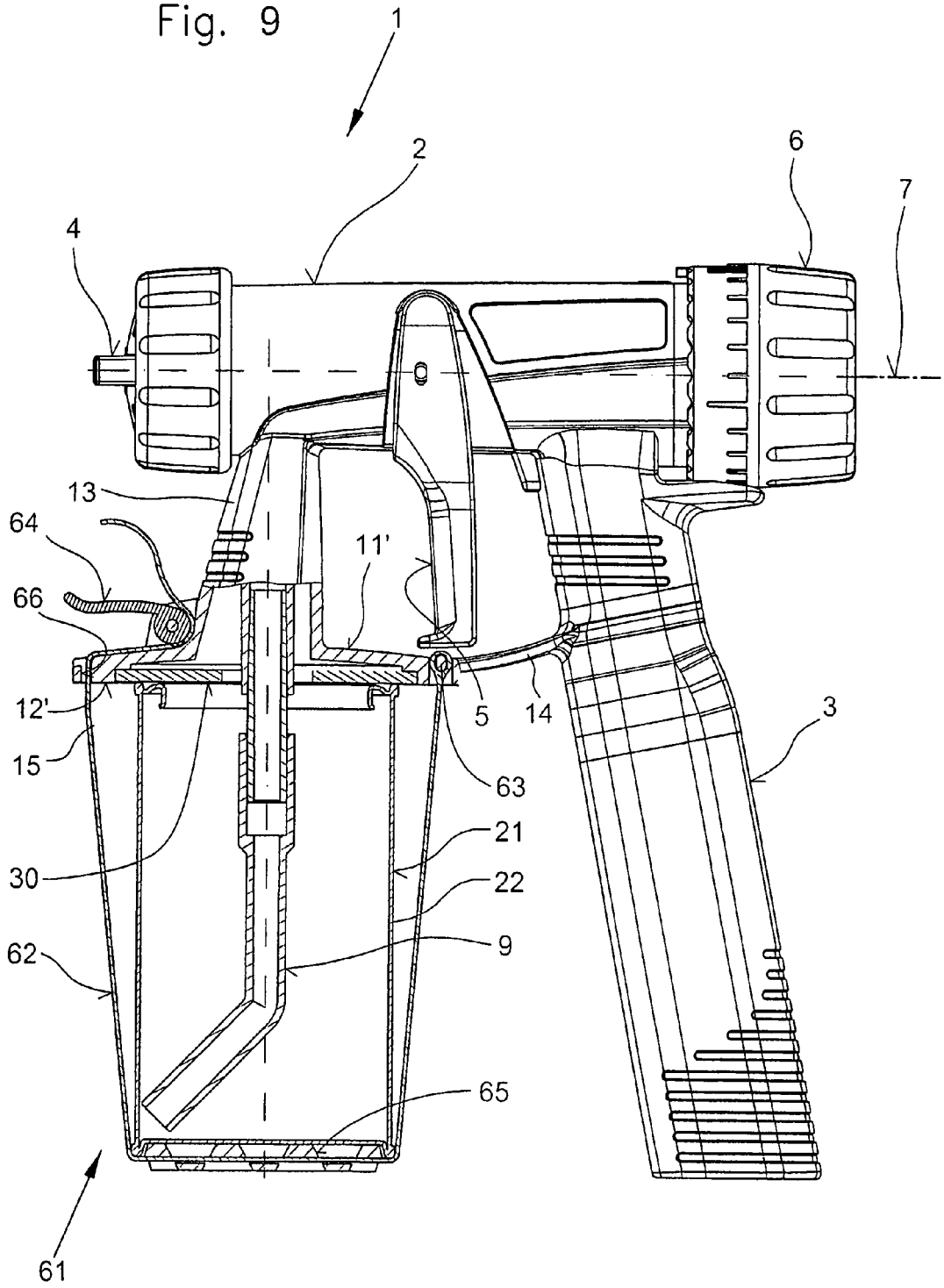
Figure 10:
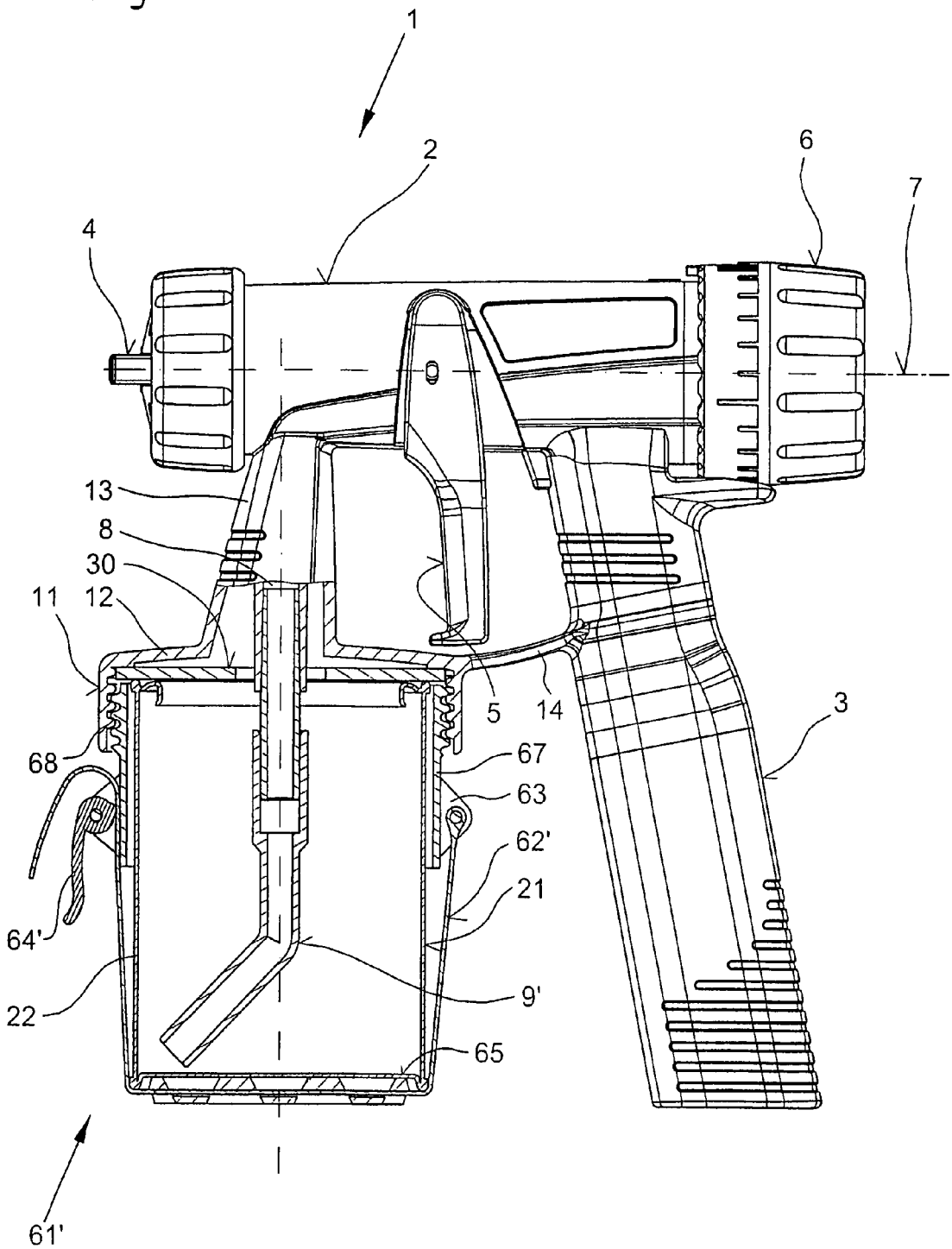

The drawing shows a spray gun configured in accordance with the present invention, with variously configured adapters attached to it for holding reservoir tanks, some of which are attached in different manners. In the drawing, FIG. 1 shows a view of the spray gun in a partial section with a storage container inserted into a screwed-in adapter as a reservoir tank, FIG. 2 shows the spray gun in accordance with FIG. 1 with a differently configured adapter, FIGS. 3 to 8 show the spray gun in accordance with FIG. 1 with differently configured adjustment elements for adapting different storage containers to the adapter, FIG. 9 shows the spray gun in accordance with FIG. 1 with a clamping belt as adapter, FIG. 10 shows the spray gun in accordance with FIG. 1 with an adapter that is also configured as a clamping belt, FIG. 11 shows the spray gun in accordance with FIG. 1 with an adapter configured as a clamping ring and FIG. 12 shows the clamping ring in accordance with FIG. 10 in a perspective view.

DESCRIPTION OF THE PREFERRED EMBODIMENTS

Figure 2:
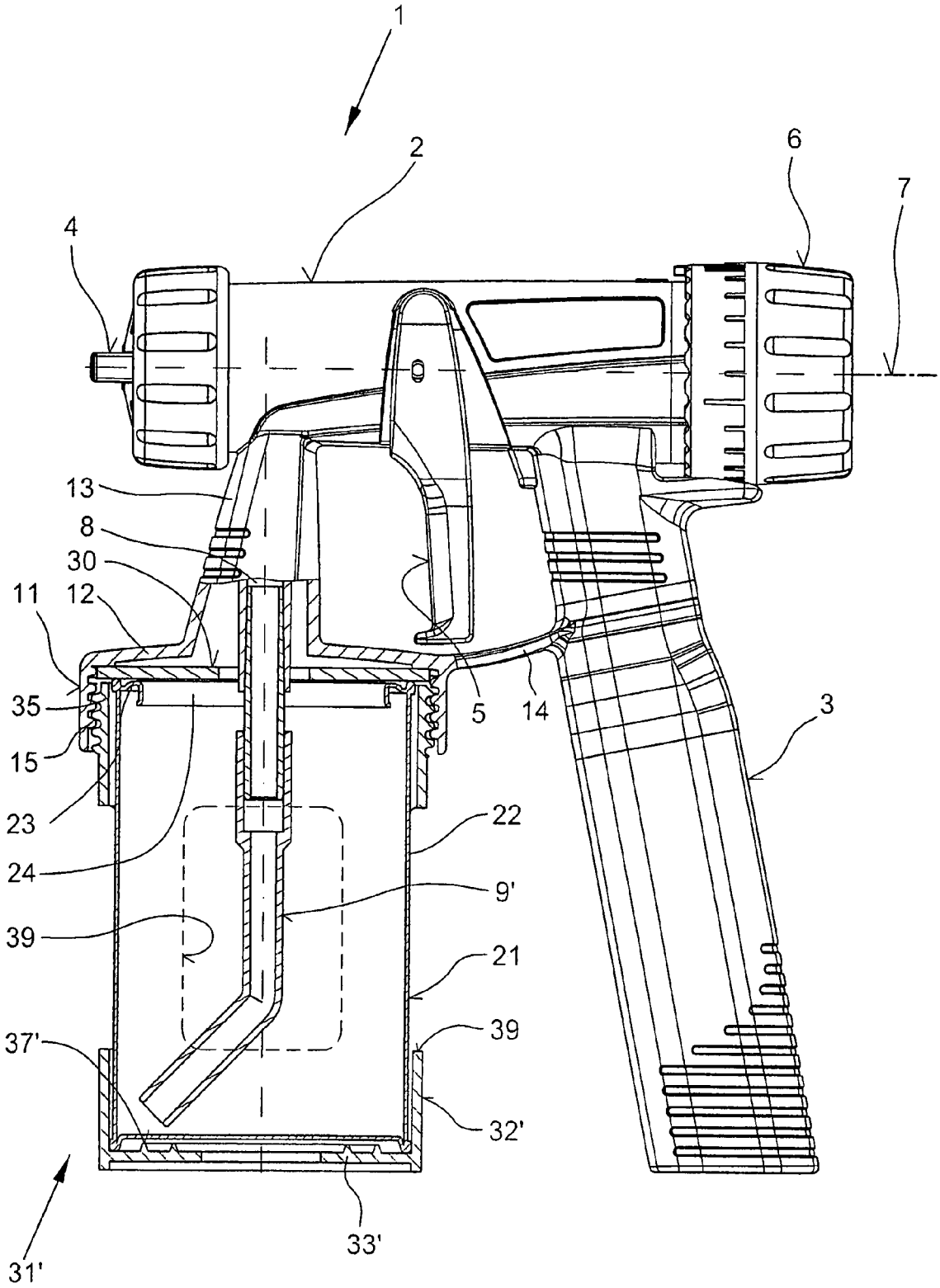

The spray gun shown in FIG. 1 and identified with 1 is used for spraying paints and similar viscous media and principally consists of a gun housing 2 for accommodating the components that are required for operating the spay gun 1, a handle 3 projecting from the gun housing 2 and a reservoir tank 21 for holding the medium to be processed. An actuating lever 5 in a swiveling mounting is provided in order to trigger a spraying operation which, when it is moved, ejects the medium sucked out of the reservoir tank 21 mixed with air out of a nozzle 4 by means of compressed air supplied via a pressure line 7. An adjusting nut 6 enables the intensity of the spray jet ejected from the nozzle 4 to be adjusted. The actuating lever 5 also enables different types of propulsion systems for the spray gun 1 to be operated, for example switching on an electrical swiveling armature pump or a blower.

The reservoir tank 21 arranged on the underside of the gun housing 2 at the level of the handle 3 in the illustrated embodiment can, however, also be arranged above and attached to the gun housing 2 so that the medium to be sprayed is supplied to the spray gun 1 by gravity. The tank 21 comprises a commercially available spray can 22 attached directly to the gun housing 2 of the spray gun by means of an adapter 31. To make this possible, a projection 11 is formed onto the gun housing 2 that is configured as a U-shaped cover 12 and is connected to the gun housing 2 and the handle 3 by means of two webs 12 and 14. A female thread 15 is worked into the projection 11 and the adapter 31 is provided with a mouthpiece 35 in the area of the can opening 24 into which a male thread 26 is worked. The nozzle 22 can therefore be securely attached to the projection 11 directly.

When the opened can 22 is screwed on after removal of a cover 23 that is only partially drawn, a riser pipe 9 projecting from the projection 11 is introduced into the can opening 24 by means of which the medium to be processed is sucked into a duct 8 by means of the air flowing into the gun housing 2, this channel 8 emerging in the inside of the gun housing 2. The paint can 22 filled with a medium prepared in an appropriate manner can therefore easily be attached to the projection 11. A seal 30 inserted between the projection 11 and the paint can 22, having an opening 30' for the riser pipe 9, thereby guarantees that the paint can 22 is connected to the spray gun 1 with a liquid-tight seal.

The adapter 31 is configured as a hollow body 32 with a U-shaped cross-section that is provided with a base 33 and walls 34 that blend into the mouthpiece 35. In order to fix the paint can 22 in the hollow body 32, a circumferential rib 37 is formed onto the base 35 and the walls 34 have individual or circumferential ribs 38 against which each paint can 22 makes contact.

In the sample embodiment shown in FIG. 2, the paint can 22 is inserted in an adapter 31' with a shape and size that is adapted to the configuration of the paint can 22. In this embodiment, support ribs 37' for the paint can 22 to make contact with are formed into the base 33' of the adapter 31' and, in addition, several penetrations 39 are worked into the walls 34'. In this manner, its is easy to tell by the paint can 22 which particular material is being processed and, also, a paint can 22 can easily be inserted into the hollow body 32' or removed from it.

Figure 3:
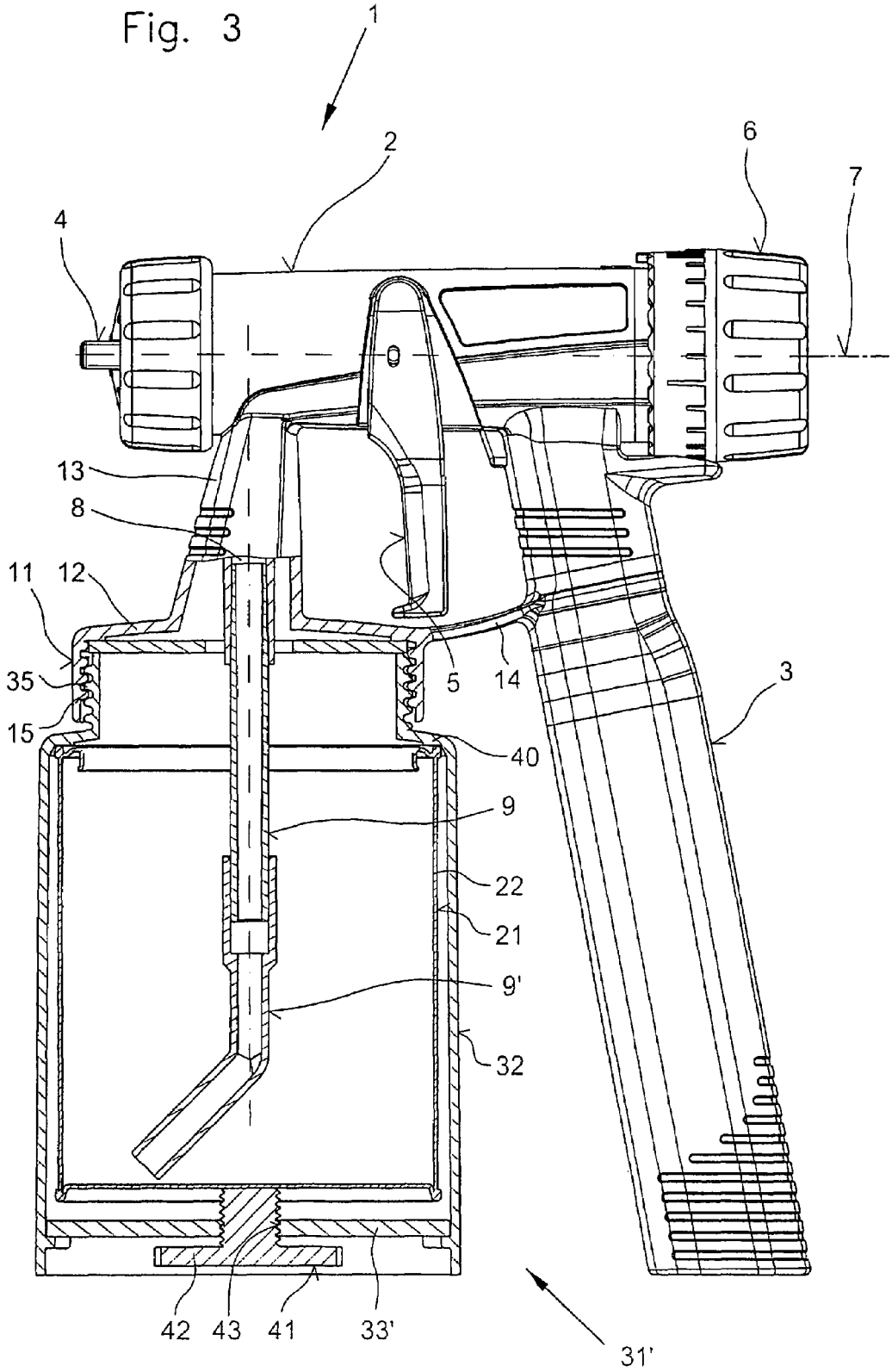
Figure 4:
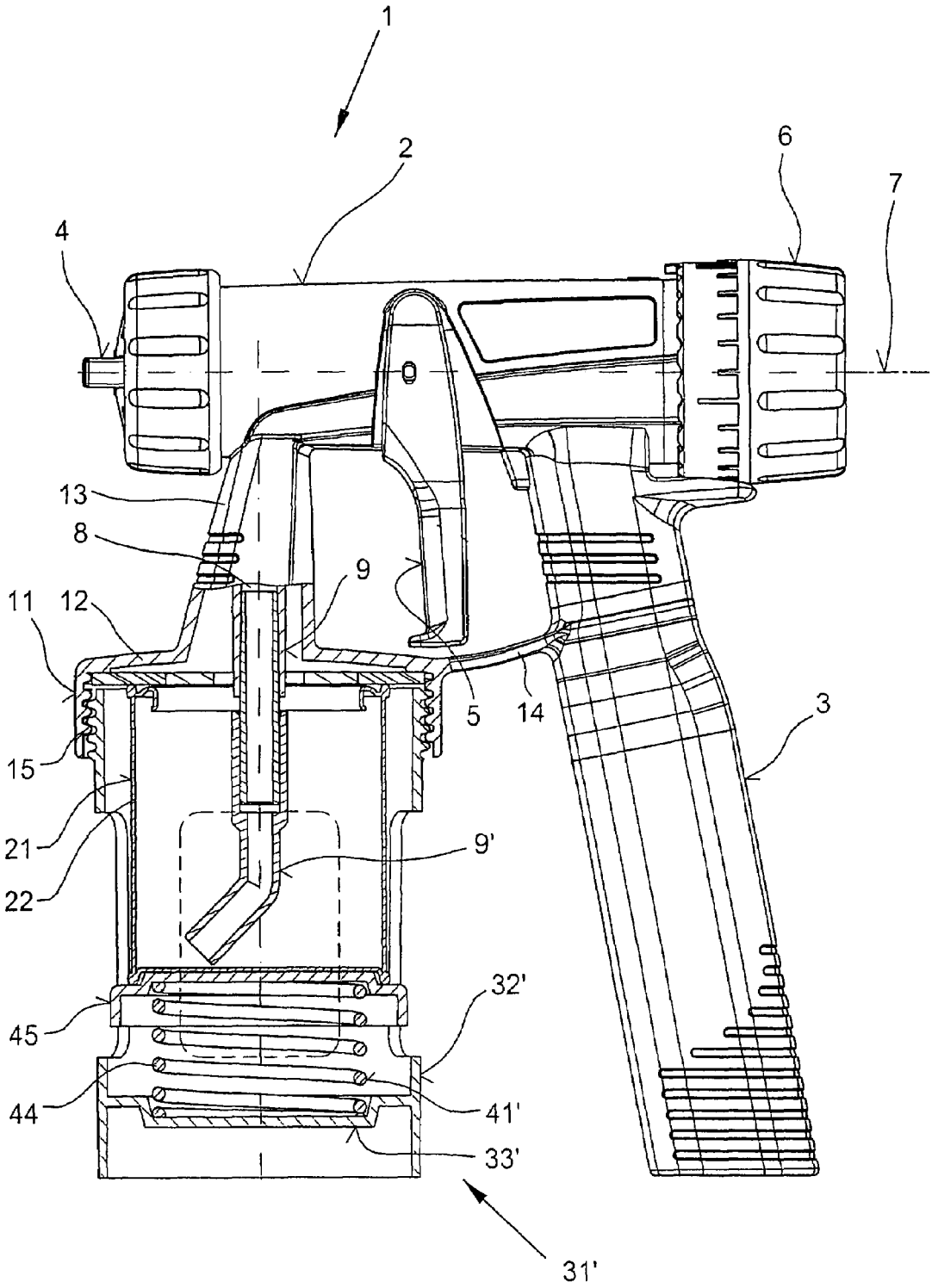

In accordance with FIGS. 3 and 4, adjustment elements 41 or 41' that act on the paint can 22 are provided in the adapter 31' in order to enable differently sized paint cans 22 to be inserted. For this purpose, the adapter 31' is equipped with a contact shoulder 40 formed by a construction in the area allocated to the projection 11, and the paint can 22 can be pressed against this contact shoulder 40 by the adjustment elements 41 or 41'.

In the embodiment shown in FIG. 3, a setscrew 42 is provided as the adjustment element 41, that can be screwed in to a thread 43 worked into the base 33' and acts directly on the paint can 33. In accordance with FIG. 4, a compression spring 44 as actuator 41' presses against the paint can 22' by means of a plate 45, the paint can 22' being supported against the base 33" of the hollow body 32'.

Figure 5:
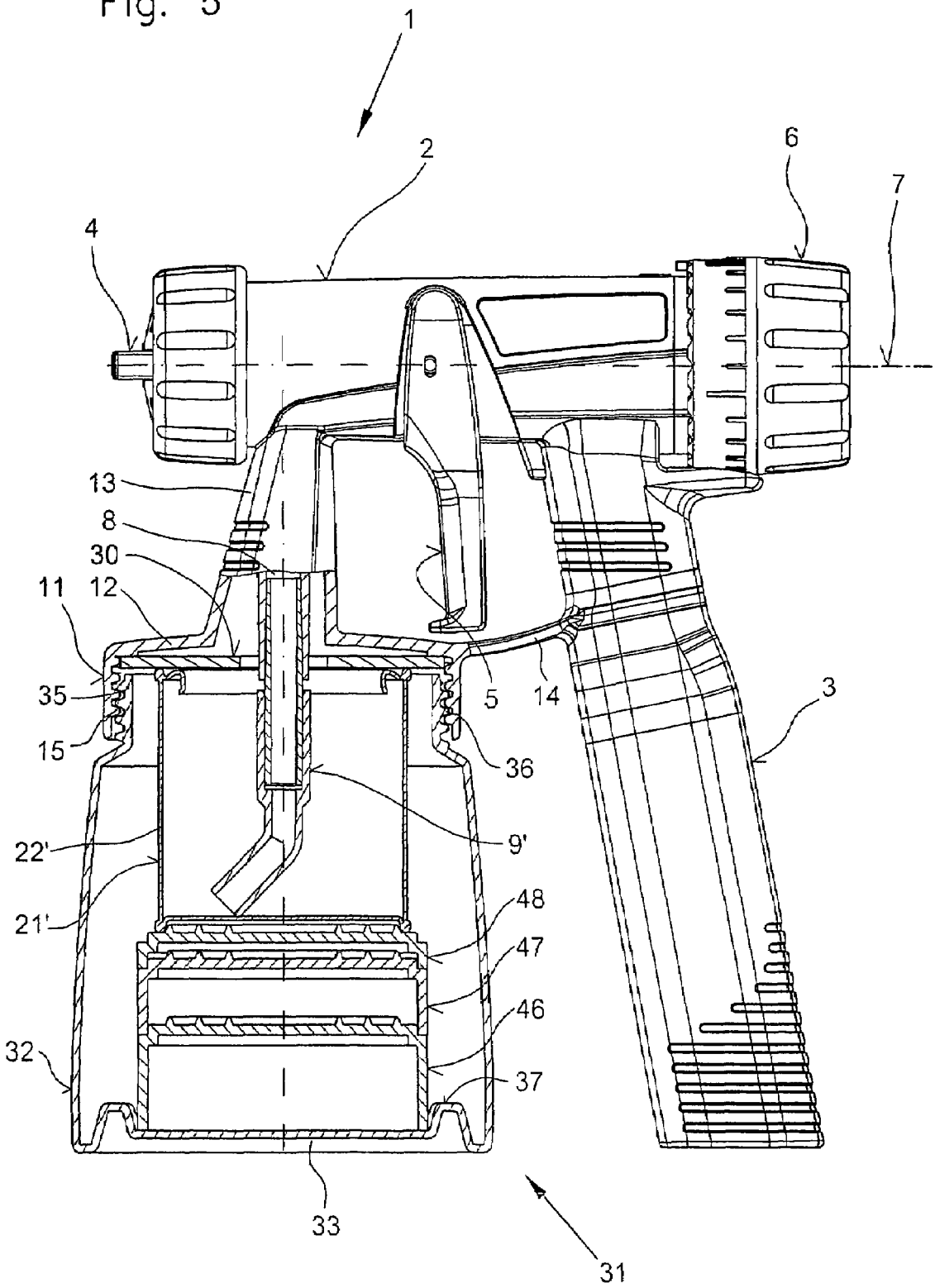
Figure 6:
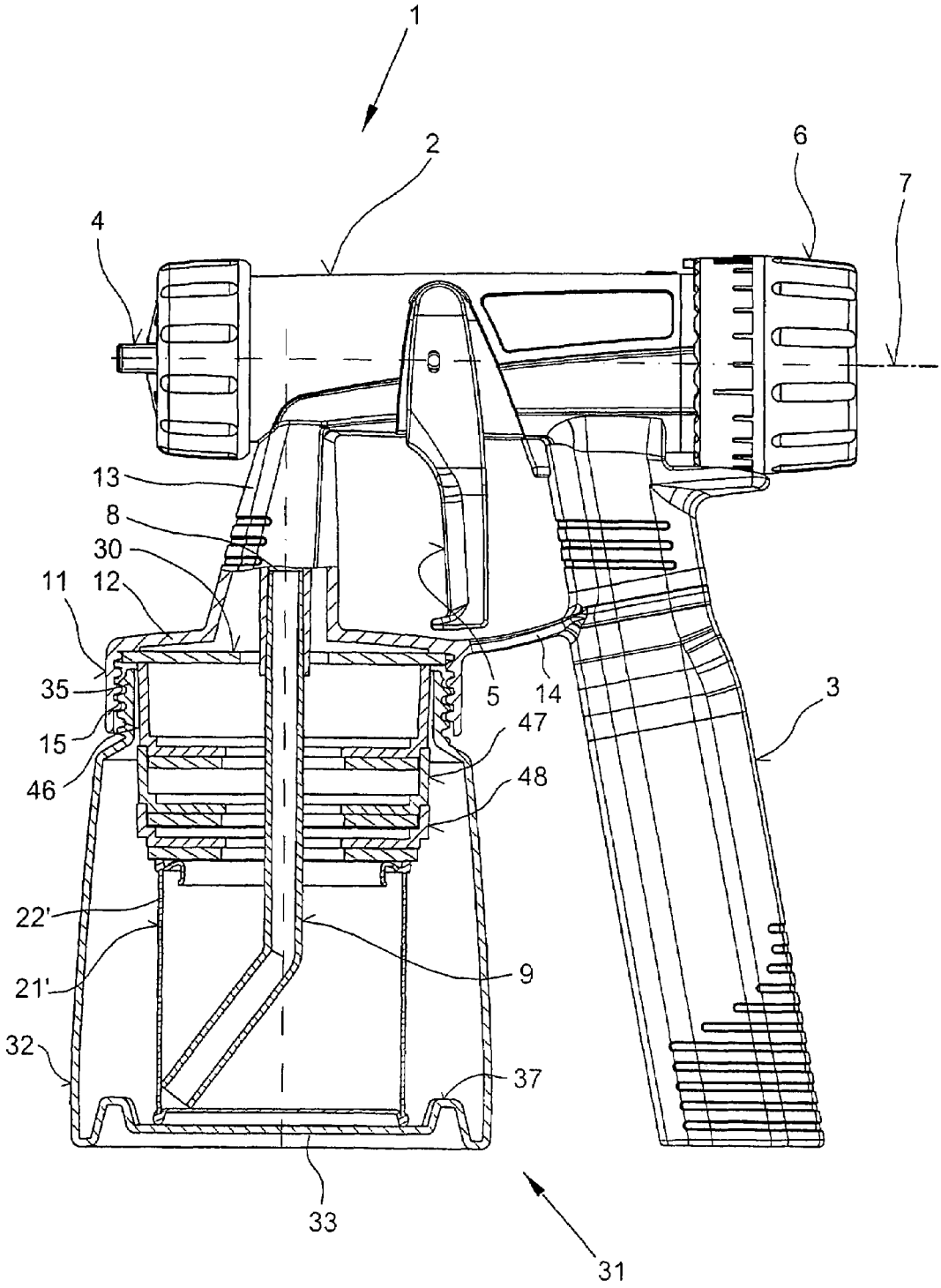

In order to compensate for different heights of the paint can 22, the embodiments shown in FIGS. 5 and 6 possess several inserts 46, 47 and 48 that have differing heights and are inserted in between the base 33 of the hollow body 32 and the paint can 22 (FIG. 5) or between the paint can 22 and the projection 11 (FIG. 6). The hollow body 32 with a U-shaped cross section as adapter 31 means that even small-sized paint cans 22' can be securely held against the projection 11.

Figure 7:
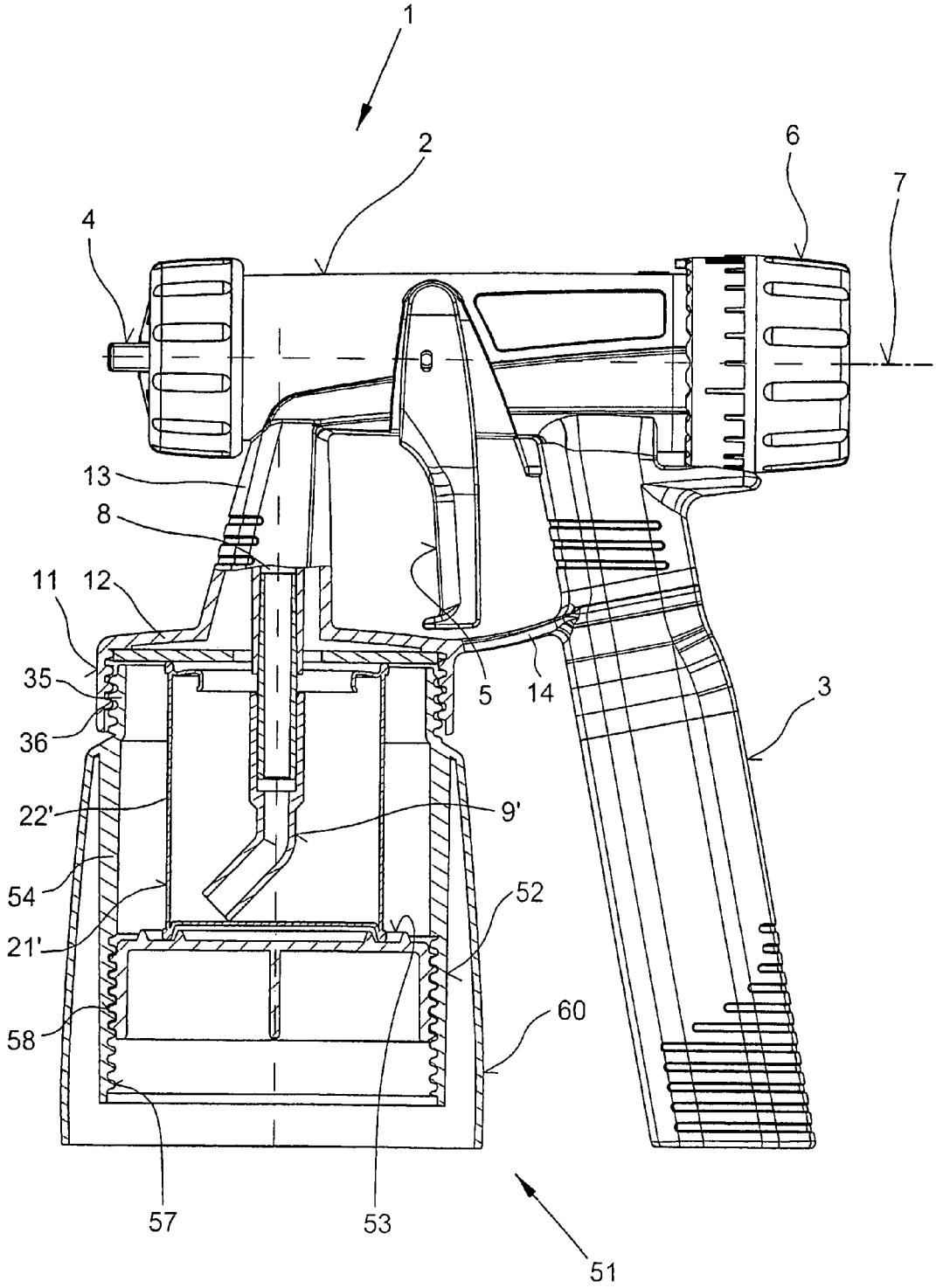
Figure 8:
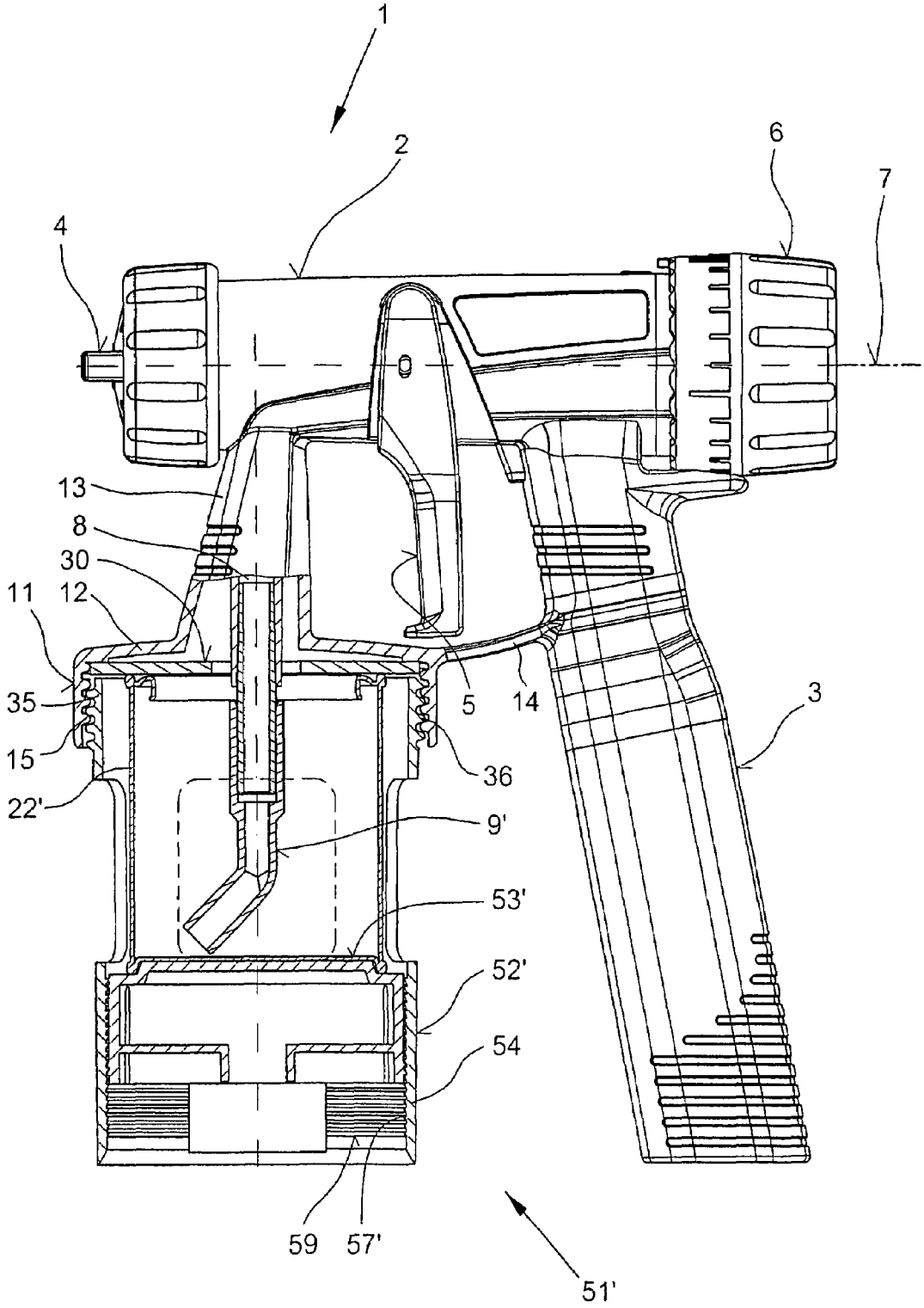

For the same purpose, the embodiments shown in FIGS. 7 and 8 have bases 53 or 53' with adjustable height inserted in adapters 51 or 51' that are also formed as hollow bodies 52 or 52'. In accordance with FIG. 7, a female thread 57 is worked into the wall 54 of the hollow body 52 and the base 53 with a U-shaped cross section is provided with a male thread 58 so that the height of the base 53 can be adjusted by screwing it to adjust to the height of the paint can 22'. As shown in FIG. 8, the base 53' can be adjusted in height and adapted to the height of the can 22' by means of a ratchet profile 59 worked into its outer jacket surface and a ratchet profile 57' provided in the walls 54 of the hollow body 52' that interacts with the ratchet profile 59.

In the embodiment shown in FIG. 7, the adapter 51 or the hollow body 52 screwed into the projection 11 is surrounded by a jacket 60 with a support surface running in the same plane as the support surface of the handle 3. The spray gun 1 can therefore be put down securely.

The adapter 61 or 61' provided for securing the paint can 22 is configured as a clamping belt 62 or 62', as shown in FIGS. 9 and 10, that is directly attached to the projection 11' configured as a plate 12' (FIG. 9) or an adapter 67 into which the projection 11 is screwed (FIG. 10).

One end of the clamping belt 62 or 62' is held on the plate 12' or the adapter 67' by means of an eyelet 63 or 63' and its other end can be clamped by means of a clamping lever 64 or 64'. The clamping belt 62 or 62' acts on the base of the paint can 22 by means of a pressure piece 65 that has the clamping belt 62 or 62' passed through it.

In the embodiment shown in FIG. 9, the clamping belt 62 is also passed through a penetration worked in the plate 12' for guidance purposes. In the embodiment shown in FIG. 10, the clamping element 67 is screwed into the insert 12 by means of a male thread 68 and is therefore held in it.

By means of the clamping belt 65 that can be adapted to the paint can 22, this means it is also possible to press paint cans of different heights reliably onto the insert 11.

The adapter 71 shown in FIGS. 11 and 12 formed as a clamping ring 72 acts on the paint can 22 by means of clamping arms 73. The clamping arms 73 in this case are spring-loaded in the radial direction and make contact with a collar 25 provided on the paint can 22. This means it is also possible to attach paint cans with different diameters to the projection 11, irrespective of their height, by pressing the cans against the seal 30 by means of the clamping arms 73.

Adaptations to the riser pipe 9 for different paint cans are made using a projection 9' that can be attached to the shortened riser pipe 9, as shown in FIGS. 2 to 5 and 7 to 11.

The invention claimed is:

1. A spray gun assembly for spraying viscous media that can be propelled pneumatically or electrically, the spray gun comprising:

a gun housing for accommodating a propulsion mechanism comprising components of the spray gun that effect at least one of mixing and metering;

a handle projecting from said gun housing; and a reservoir tank removably attachable to said gun housing for holding the medium to be propelled; and means for introducing the medium from said reservoir tank into said housing of the spray gun via a feed duct provided with a riser pipe; wherein said reservoir tank (21) comprises a storage container attachable to a projection extending from said housing by means of an adapter for retaining said reservoir tank, the projection comprising a selected one of a cover and a plate connected to a selected one of said gun housing by a web and said handle by a web, and said adapter comprises a hollow body enclosing said reservoir tank; and a selected number of inserts disposed in said hollow body;

said inserts being selected from inserts provided with different heights and being interlockable to form support of a selected length between said reservoir tank and a selected one of a hollow body wall and a seal.

2. The spray gun in accordance with claim 1, wherein the adapter comprises a hollow body in the form of a pot into which said storage container is insertable in an oriented position.

3. The spray gun in accordance with claim 1, wherein the adapter is threadedly connectable with the projection by means of a male thread provided on a mouthpiece extending from said the adapter.

4. The spray gun in accordance with claim 2, wherein to hold said storage container in the adapter in an oriented position, said hollow body (32) is provided with projecting support ribs in an area of a base of said hollow body.

5. The spray gun in accordance with claim 2, wherein said hollow body (32') of the adapter (31') is adapted to receive said storage container.

* * * * *